US011063332B1

(12) United States Patent
Xiong et al.

(10) Patent No.: US 11,063,332 B1
(45) Date of Patent: Jul. 13, 2021

(54) SUBMINIATURE CIRCULATOR

(71) Applicant: Shenzhen Huayang Technology Development Co., Ltd., Shenzhen (CN)

(72) Inventors: Fei Xiong, Shenzhen (CN); Wei Zhang, Shenzhen (CN)

(73) Assignee: Shenzhen Huayang Technology Development Co., Ltd., Shenzhen (CN)

( * ) Notice: Subject to any disclaimer, the term of this patent is extended or adjusted under 35 U.S.C. 154(b) by 98 days.

(21) Appl. No.: 16/619,250

(22) PCT Filed: Aug. 30, 2018

(86) PCT No.: PCT/CN2018/103299
§ 371 (c)(1),
(2) Date: Dec. 4, 2019

(87) PCT Pub. No.: WO2020/042092
PCT Pub. Date: Mar. 5, 2020

(51) Int. Cl.
*H01P 1/387* (2006.01)
*H01P 1/383* (2006.01)

(52) U.S. Cl.
CPC ..... *H01P 1/383* (2013.01); *H01P 1/387* (2013.01)

(58) Field of Classification Search
CPC .... H01P 1/38; H01P 1/383; H01P 1/32; H01P 1/36; H01P 1/387
USPC ..... 333/1.1, 24.2
See application file for complete search history.

(56) References Cited

U.S. PATENT DOCUMENTS 6,011,449 A * 1/2000 Jussaume ..... H01P 1/387 174/541
2007/0182504 A1* 8/2007 Mukai ..... H01P 1/387 333/1.1

FOREIGN PATENT DOCUMENTS

CN 103367849 A * 10/2013 ..... H01P 1/39

* cited by examiner

*Primary Examiner* — Stephen E. Jones
(74) *Attorney, Agent, or Firm* — Westbridge IP LLC

(57) ABSTRACT

A subminiature circulator includes feed pin assemblies, a hollow base having an opening formed in the top, and a locating iron sheet, wherein a laminated assembly is arranged in the base, notches are formed in the peripheral wall of the base and are communicated with the bottom face of the base, the locating iron sheet is clamped in the laminated assembly and is provided with extension parts which stretch out of the base via the notches, and the feed pin assemblies are installed in installation holes formed in the extension parts. The feed pin assemblies are arranged in the installation holes formed in the extension parts of the locating iron sheet, and such installation manner is not limited to an integrally-formed structure, so that a sophisticated device is easy to machine in the fabrication process.

10 Claims, 2 Drawing Sheets

SUBMINIATURE CIRCULATOR

TECHNICAL FIELD

The invention relates to communication devices, in particular to a subminiature circulator.

BACKGROUND

With the continuous development and evolution of communication technologies, 5G networks with low power consumption, high capacity, low delay, and wide coverage have become a research and development hotspot in the industry. The demand of 5G communication systems for a large quantity of antenna arrays puts forward a requirement for subminiaturization of devices in the communication systems. As the core device of power amplification units of the communication systems, microwave circulators are also required to be subminiature.

Existing circulators comprise a hollow base having an opening formed in the top, wherein a laminated assembly is arranged in the hollow base, three notches are formed in the base and have bottoms provided with support bases, feed pin assemblies electrically connected to a central conductor in the laminated assembly are arranged on the support bases which are integrated with the base into a whole, and generally, the support bases are formed by milling. With regard to subminiature circulators provided with a very small base, a bigger challenge will be undoubtedly posed on machining precision (inconsistent depths of notches may lower the performance of the circulators) when the notches are milled in such small base to form support bases, and consequentially, the machining difficulty of the circulators is increased.

SUMMARY

The technical issue to be settled by the invention is to provide a subminiature circulator which is convenient to machine.

The technical solution adopted by the invention to settle the technical issue is as follows: a subminiature circulator comprises feed pin assemblies, a hollow base having an opening formed in the top, and a locating iron sheet, wherein a laminated assembly is arranged in the base, notches are formed in the peripheral wall of the base and are communicated with the bottom face of the base, the locating iron sheet is clamped in the laminated assembly and is provided with extension parts which stretch out of the base via the notches, and the feed pin assemblies are installed in installation holes formed in the extension parts.

Furthermore, the number of the notches and the number of the extension parts are three respectively, and the three notches are in one-to-one correspondence with the three extension parts.

Furthermore, the extension parts are as wide as the notches.

Furthermore, the laminated assembly includes a ferrite magnet, a lower ferrite, a central conductor, an upper ferrite, a uniform magnetic sheet, a samarium-cobalt magnet, a temperature compensation sheet, and a cover plate which are sequentially stacked from bottom to top, wherein the locating iron sheet is clamped between the ferrite magnet and the lower ferrite.

Furthermore, the laminated assembly further includes two dielectric rings, wherein the upper ferrite is received in one dielectric ring, and the lower ferrite is received in the other dielectric ring.

Furthermore, each feed pin assembly includes a PIN and an insulator, wherein the insulator is disposed around the PIN and is installed in the corresponding installation hole, and the PIN is electrically connected to the central conductor.

Furthermore, the base is made from cold rolled steel.

Furthermore, the base is formed by stamping.

Furthermore, riveting columns which extend upwards are arranged on the top face of the base, riveting holes matched with the riveting columns are formed in the cover plate, and the base is in riveting connection with the cover plate through the riveting columns and the riveting holes.

Furthermore, a plurality of notches are formed in the base, and at least one riveting column is arranged between every two adjacent notches.

The invention has the following beneficial effects: the feed pin assemblies are installed in the installation holes formed in the extension parts of the locating iron sheet, and such installation manner is not limited to an integrally-formed structure, so that a sophisticated device is easy to machine in the fabrication process.

REFERENCE SIGNS

1, base;
2, locating iron sheet;
3, extension part;
4, installation hole;
5, ferrite magnet;
6, lower ferrite;
7, central conductor;
8, upper ferrite;
9, uniform magnetic sheet;
10, samarium-cobalt magnet;
11, temperature compensation sheet;
12, cover plate;
13, dielectric ring;
14, PIN;
15, insulator;
16, riveting column;
17, riveting hole.

DETAILED DESCRIPTION OF THE EMBODIMENTS

The technical contents, purposes, and effects of the invention are expounded as follows in combination with the embodiments and accompanying drawings.

The key concept of the invention lies in that: feed pin assemblies are installed in installation holes formed in extension parts of a locating iron sheet, so that the machining difficulty is lowered.

Figure 1:
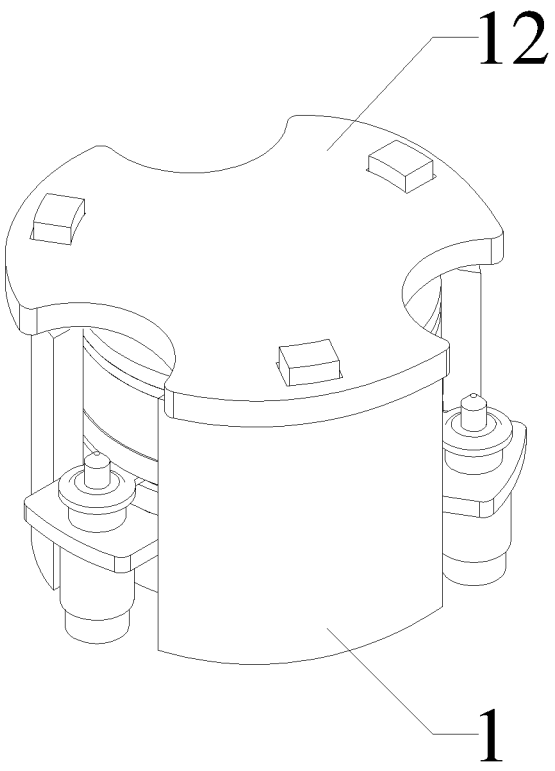
FIG. 1 is an overall structural view of a subminiature circulator in Embodiment 1 of the invention.
Figure 2:
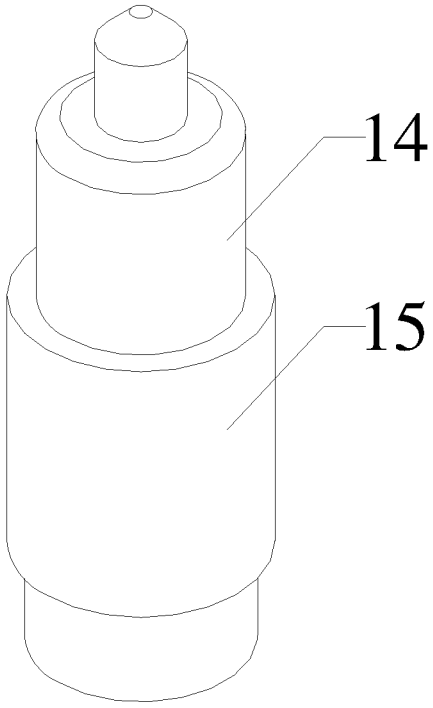
FIG. 2 is a structural view of a feed pin assembly of the subminiature circulator in Embodiment 1 of the invention.
Figure 3:
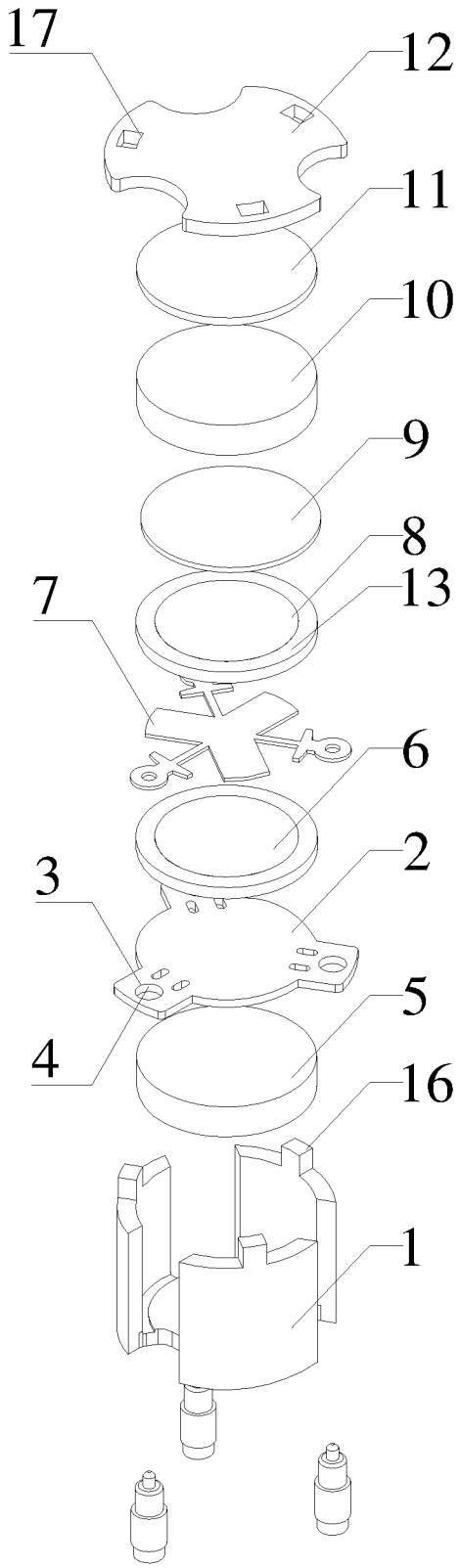
FIG. 3 is an exploded view of the subminiature circulator in Embodiment 1 of the invention.

Referring to FIG. 1 to FIG. 3, a subminiature circulator comprises feed pin assemblies, a hollow base 1 having an opening formed in the top, and a locating iron sheet 2, wherein a laminated assembly is arranged in the base 1, notches are formed in the peripheral wall of the base 1 and are communicated with the bottom face of the base 1, the locating iron sheet 2 is clamped in the laminated assembly and is provided with extension parts 3 which stretch out of the base 1 via the notches, and the feed pin assemblies are installed in installation holes 4 formed in the extension parts 3.

The structural principle of the invention is briefly described as follows: the installation holes allow the feed pin assemblies to be installed therein are formed in the locating iron sheet which is clamped in the laminated assembly, so that compared with an integrally-formed structure, support bases do not need to be machined on the base.

From the above description, the invention has the following beneficial effects: the feed pin assemblies are installed in the installation holes formed in the extension parts of the locating iron sheet, and such installation manner is not limited to the integrally-formed structure, so that a sophisticated device is easy to machine in the fabrication process.

Furthermore, the number of the notches and the number of the extension parts 3 are three respectively, and the three notches are in one-to-one correspondence with the three extension parts 3.

Furthermore, extension parts 3 are as wide as the notches.

From the above description, the extension parts stretch into the notches to prevent the locating iron sheet from rotating in the horizontal direction.

Furthermore, the laminated assembly includes a ferrite magnet 5, a lower ferrite 6, a central conductor 7, an upper ferrite 8, a uniform magnetic sheet 9, a samarium-cobalt magnet 10, a temperature compensation sheet 11, and a cover plate 12 which are sequentially stacked from bottom to top, wherein the locating iron sheet 2 is clamped between the ferrite magnet 5 and the lower ferrite 6.

Furthermore, the laminated assembly further includes two dielectric rings 13, wherein the upper ferrite 8 is received in one dielectric ring 13, and the lower ferrite 6 is received in the other dielectric ring 13.

From the above description, the ferrites are received in the dielectric rings having a high dielectric constant, so that the electrical properties of products are improved.

Furthermore, each feed pin assembly includes a PIN 14 and an insulator 15, wherein the insulator 15 is disposed around the PIN 14 and is installed in the corresponding installation hole 4, and the PIN 14 is electrically connected to the central conductor 7.

From the above description, the insulators have an insulation effect, so that signal leakage is prevented.

Furthermore, the base 1 is made from cold rolled steel.

Furthermore, the base 1 is formed by stamping.

From the above description, the stamping process is relatively simple, and cold rolled steel products have high rigidity and strength.

Furthermore, riveting columns 16 which extend upwards are arranged on the top face of the base 1, riveting holes 17 matched with the riveting columns 16 are formed in the cover plate 12, and the base 1 is in riveting connection with the cover plate 12 through the riveting columns 16 and the riveting holes 17.

From the above description, the cover plate is in riveting connection with the base, and threaded parts do not need to be machined on the cover plate and the base, so that the machining difficulty of the circulator is lowered.

Furthermore, a plurality of notches are formed in the base 1, and at least one riveting column 16 is arranged between every two adjacent notches.

From the above description, a plurality of riveting columns in riveting connection with the cover plate are arranged on the base, so that the connection stability between the cover plate and the base is improved.

Embodiment 1

Referring to FIG. 1 to FIG. 3, Embodiment 1 of the invention is as follows: a subminiature circulator comprises feed pin assemblies, a hollow base 1 having an opening formed in the top, and a locating iron sheet 2, wherein the external diameter of the base 1 is optionally less than 10 mm and is preferably 7 mm; a laminated assembly is arranged in the base 1, and notches are formed in the peripheral wall of the base 1 and are communicated with the bottom face of the base 1; and the locating iron sheet 2 is clamped in the laminated assembly and is provided with extension parts 3 which stretch out of the base 1 via the notches, and the feed pin assemblies are arranged in installation holes 4 formed in the extension parts 3.

In this embodiment, the number of the notches and the number of the extension parts 3 are three respectively, and the three notches are in one-to-one correspondence with the three extension parts 3. Particularly, the extension parts 3 are as wide as the notches. Preferably, the three notches are annularly spaced from one another by an angle of 120°, so that uniform stress is realized, and the structural rigidity of the products is improved.

Particularly, the laminated assembly includes a ferrite magnet 5, a lower ferrite 6, a central conductor 7, an upper ferrite 8, a uniform magnetic sheet 9, a samarium-cobalt magnet 10, a temperature compensation sheet 11, and a cover plate 12 which are sequentially stacked from bottom to top, wherein the locating iron sheet 2 is clamped between the ferrite magnet 5 and the lower ferrite 6. Preferably, the ferrites are composite ferrites which are machined by co-firing, so that an annular size and insertion loss can be effectively reduced.

Particularly, the laminated assembly further includes two dielectric rings 13, wherein the upper ferrite 8 is received in one dielectric ring 13, and the lower ferrite 6 is received in the other dielectric ring 13. Preferably, the dielectric rings 13 are ceramic dielectric rings having a dielectric constant of 50.

In this embodiment, each feed pin assembly includes a PIN 14 and an insulator 15, wherein the insulator 15 is disposed around the PIN 14 and is installed in the corresponding installation hole 4, and the PIN 14 is electrically connected to the central conductor 7. In this embodiment, the base 1 is made from cold rolled steel through a stamping process stamping.

Particularly, riveting columns 16 which extend upwards are arranged on the top face of the base 1, riveting holes 17 matched with the riveting columns 16 are formed in the cover plate 12, and the base 1 is in riveting connection with the cover plate 12 through the riveting columns 16 and the riveting holes 17.

Optionally, a plurality of notches are formed in the base 1, and at least one riveting column 16 is arranged between every two adjacent notches. Preferably, the number of the notches is three, and one riveting column 16 is arranged between every two adjacent notches.

In conclusion, according to the subminiature circulator of the invention, the feed pin assemblies are installed in the installation holes formed in the extension parts of the locating iron sheet, and such installation manner is not limited to the integrally-formed structure, so that a sophisticated device is easy to machine in the fabrication process; the extension parts stretch into the notches to prevent the locating iron sheet from rotating in the horizontal direction; the dielectric rings have a high dielectric constant, so that the electrical properties of the products are improved; the base is easy to machine, and the products have high rigidity and strength; the cover plate is in riveting connection with the base, and the threaded parts do not need to be machined on the cover plate and the base, so that the machining difficulty of the circulator is lowered; and the plurality of riveting columns in riveting connection with the cover plate are arranged on the base, so that the connection stability of the cover plate and the base is improved.

The above embodiments are only illustrative ones of the invention, and are not intended to limit the patent scope of the invention. All equivalent transformations obtained on the basis of the contents in the specification and the accompanying drawings of the invention, or direct or indirect applications to related technical fields should also fall within the patent protection scope of the invention.

What is claimed is:

1. A subminiature circulator, comprising feed pin assemblies, a hollow base having an opening formed in a top, and a locating iron sheet, wherein a laminated assembly is arranged in the base, notches are formed in a peripheral wall of the base and are communicated with a bottom face of the base, the locating iron sheet is clamped in the laminated assembly and is provided with extension parts which stretch out of the base via the notches, and the feed pin assemblies are installed in installation holes formed in the extension parts.

2. The subminiature circulator according to claim 1, wherein the number of the notches and the number of the extension parts are three respectively, and the three notches are in one-to-one correspondence with the three extension parts.

3. The subminiature circulator according to claim 1, wherein the extension parts are as wide as the notches.

4. The subminiature circulator according to claim 1, wherein the base is made from cold rolled steel.

5. The subminiature circulator according to claim 1, wherein the base is formed by stamping.

6. The subminiature circulator according to claim 1, wherein riveting columns which extend upwards are arranged on a top face of the base, riveting holes matched with the riveting columns are formed in a cover plate, and the base is in riveting connection with the cover plate through the riveting columns and the riveting holes.

7. The subminiature circulator according to claim 6, wherein a plurality of the notches are formed in the base, and at least one said riveting column is arranged between every two adjacent notches.

8. The subminiature circulator according to claim 1, wherein the laminated assembly includes a ferrite magnet, a lower ferrite, a central conductor, an upper ferrite, a uniform magnetic sheet, a samarium-cobalt magnet, a temperature compensation sheet, and a cover plate which are sequentially stacked from bottom to top, wherein the locating iron sheet is clamped between the ferrite magnet and the lower ferrite.

9. The subminiature circulator according to claim 8, wherein the laminated assembly further includes two dielectric rings, wherein the upper ferrite is received in one said dielectric ring, and the lower ferrite is received in the other dielectric ring.

10. The subminiature circulator according to claim 8, wherein each said feed pin assembly includes a pin and an insulator, wherein the insulator is disposed around the pin and is arranged in each said installation hole, and the pin is electrically connected to the central conductor.

* * * * *